US005385314A

United States Patent [19]

Hughes

[11] Patent Number: 5,385,314

[45] Date of Patent: Jan. 31, 1995

[54] CABLE REEL LEVEL WIND MECHANISM

[75] Inventor: Daniel L. Hughes, Portland, Oreg.

[73] Assignee: Wagner Mining and Construction Equipment Co., Portland, Oreg.

[21] Appl. No.: 932,328

[22] Filed: Aug. 18, 1992

[51] Int. Cl.[6] ..... B65H 57/28; B65H 75/42

[52] U.S. Cl. ..... 242/397.3; 242/403

[58] Field of Search ..... 242/86.51, 158.1, 241, 242/278, 281, 86.61

[56] References Cited

U.S. PATENT DOCUMENTS

| | | | |
|---|---|---|---|
| 513,083 | 1/1894 | Carsten | 242/158.1 |
| 708,979 | 9/1902 | Heylman | 242/158.1 |
| 969,598 | 9/1910 | Buttles | 242/158.1 |
| 1,491,305 | 4/1924 | Hop et al. | 242/158.1 |
| 2,650,036 | 2/1951 | Berkepeis | 242/43 |
| 2,968,446 | 1/1961 | Selby | 242/158.1 X |
| 3,078,060 | 2/1963 | Le Bus, Sr. | 242/157.1 |
| 3,164,336 | 1/1965 | Redman | 242/158 |
| 3,363,849 | 1/1968 | McLarty | 242/7 |
| 3,367,602 | 2/1968 | Morling | 242/158.1 |
| 3,409,245 | 11/1968 | Grace | 242/278 X |
| 4,252,154 | 2/1981 | Alexander, III | 242/158.1 X |
| 4,583,700 | 4/1986 | Tschurbanoff | 242/86.51 |
| 4,666,102 | 5/1987 | Colbaugh et al. | 242/86.51 X |
| 5,007,599 | 4/1991 | Forsyth | 242/86.51 |

FOREIGN PATENT DOCUMENTS

| | | |
|---|---|---|
| 0088868A1 | 9/1983 | European Pat. Off. . |
| 1431926 | 7/1973 | United Kingdom . |

OTHER PUBLICATIONS

Partial translation into English of German language patent No. 0088868A1 (3 pages).

*Primary Examiner*—John M. Jillions
*Attorney, Agent, or Firm*—Klarquist Sparkman Campbell Leigh & Whinston

[57] ABSTRACT

A cable guide mechanism for evenly winding a cable for an electric powered vehicle onto an on-board reel having a cable guide that is reciprocated across the reel to neatly and closely wind the cable onto the reel. The cable guide is driven by a drive linkage to reciprocate in proportion to rotation of the take-up reel. The drive linkage includes a lever having a fixed pivot end and a free end attached to the cable guide. An eccentric crank driven by the rotation of the take-up reel is attached to a connecting rod that connects the end of the crank to an intermediate point on the lever arm. Accordingly, the range of reciprocation of the cable guide is substantially greater than the diameter of the path swept out by the crank, and the drive linkage may be contained in a compact package.

26 Claims, 2 Drawing Sheets

CABLE REEL LEVEL WIND MECHANISM

TECHNICAL FIELD

This invention relates to apparatus for evenly winding cable onto a take-up reel, and more particularly to such apparatus for reciprocating a cable guide on an electric vehicle.

BACKGROUND OF THE INVENTION

Electric vehicles powered by trailing cables are used in underground mining operations where internal combustion vehicles are unsafe, and battery powered vehicles are impractical. To avoid dragging the entire cable, a cable reel is typically mounted on the vehicle to pay out and take up cable as the vehicle moves away from and toward the power source to which the cable is connected. Although the mining vehicle is operated to remain facing generally away from the direction of the trailing cable to avoid treading on its own cable, the vehicles must maneuver around corners and over sloped obstacles. Consequently, the trailing cable may extend at an angle substantially offset vertically or horizontally from the rear of the vehicle. This causes the cable to wrap unevenly about the cable reel, risking snags and resulting in a looser, more random wrap of cable about the reel. Because space is at a premium in underground mining vehicles, the larger reel required to accommodate a loosely-wrapped length of cable is disadvantageous.

Various mechanisms have been employed to reciprocate a guide to effect a more uniform wrap of cable or other material on a reel. A conventional ball reverser of the type employed in fishing reels is functionally suitable, but is prohibitively expensive, particularly for such large-scale, heavy duty applications as mining vehicles. In addition, the harsh and abrasive environment in which mining vehicles operate is likely to damage a precisely machined ball reverser.

Although unknown in applications for winding electrical cable in a closely coiled configuration, a conventional reciprocating block such as shown in U.S. Pat. No. 2,650,036 to Berkepeis has been used as a reciprocating thread guide. This apparatus employs a conventional crank and connecting rod assembly for converting rotational motion into reciprocating linear motion of a generally sinusoidal nature. Such a mechanism is unsuitable for a mining vehicle because it is undesirably bulky. The entire mechanism extends well beyond the planar ends of the spool on which the wire is being wound; the crank disk alone must have at least as large a diameter as the desired reciprocating range of the guide.

SUMMARY OF THE INVENTION

The primary objects of the invention are to provide:

A cable reel level wind mechanism that overcomes the above stated disadvantages of the prior art.

A mechanism as aforesaid which is sufficiently compact so that it does not occupy substantial space in addition to the volume of the cable reel, and particularly which does not extend substantially beyond the end plates of the cable reel.

A mechanism as aforesaid which may be affordably manufactured and which is ruggedly constructed for extended use in harsh, abrasive environments.

According to the present invention, the above objects are achieved by providing a cable reel level wind mechanism having a take-up reel, a cable guide movable over the cable reel, a small diameter eccentric crank rotationally driven with the cable reel, a lever connected at one end to the cable guide and at the other end to a fixed pivot, and a connecting rod connected between the crank and an intermediate point on the lever. Because the connecting rod is attached to the lever at an intermediate point closer to the pivot than is the cable guide, the cable guide is reciprocated through a substantially wider range of motion than the diameter of crank rotation.

The foregoing and additional features and advantages of the present invention will be more readily apparent from the following detailed description which proceeds with reference to the accompanying drawings,

DETAILED DESCRIPTION OF A PREFERRED EMBODIMENT

Figures 1, 4:
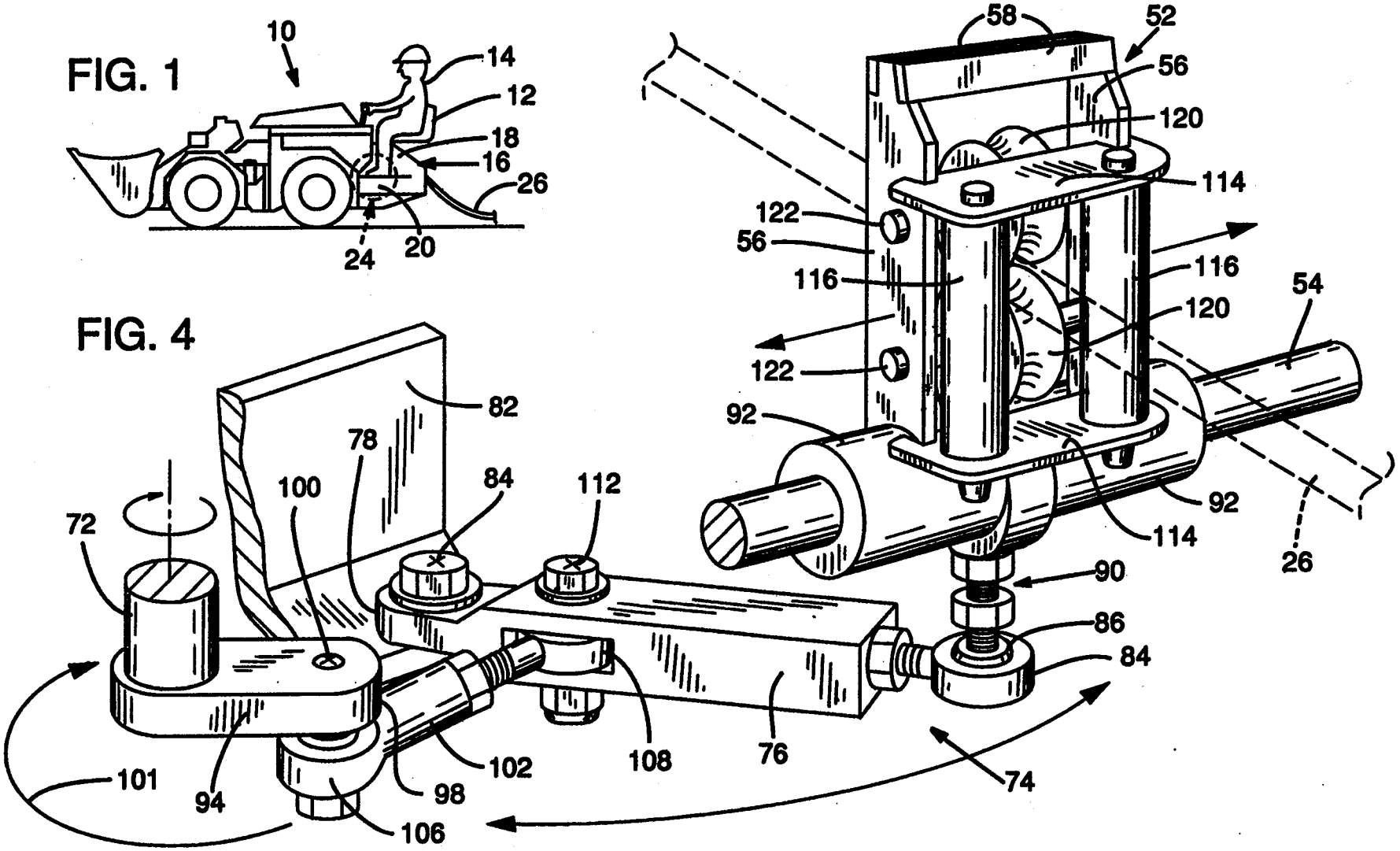
FIG. 1 is a side view of the present invention as installed on a mining vehicle.
FIG. 4 is a detailed fragmentary perspective view of the drive linkage of the embodiment of FIG. 1.
Figure 2:
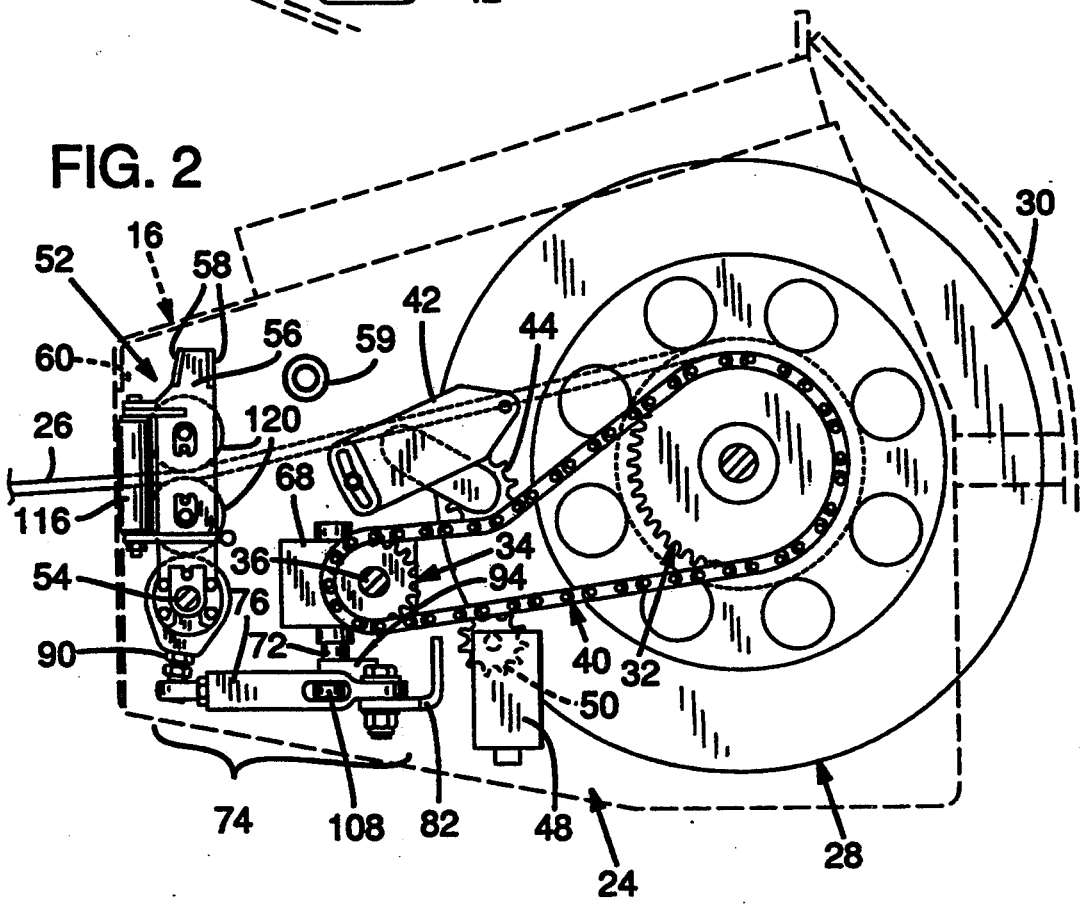
FIG. 2 is a side view of the embodiment of FIG. 1.

FIG. 1 shows a mining vehicle 10 having an aft-mounted seat 12 for an operator 14. A reel housing 16 is attached at the rear of the vehicle so that the operator 14 may sit astride an upper portion 18 of the housing with the operator's feet resting on a lower portion 20 of the housing, A cable reel level wind mechanism 24 is contained within the housing 16 and serves to pay out and take up a trailing power cable 26 that is connected to provide electric power to the vehicle, As shown in FIG. 2, the cable reel level wind mechanism 24 is mounted within the reel housing 16 with a cable reel 28 journaled for rotation on a horizontal axle fixed to the vehicle. The reel includes end plates 30 that are spaced apart to define the length of the reel. A reel sprocket wheel 32 is fixed to one of the reel end plates 30 to rotate therewith. A motor sprocket wheel 34 is mounted in planar alignment with the reel sprocket 32 to rotate with a motor shaft 36. A drive chain 40 engages the reel sprocket 32 and motor sprocket 34 to provide proportional rotation thereof.

An adjustable tensioner mechanism 42 includes a tensioner sprocket 44 to maintain the drive chain 40 under tension. The tensioner 42 is preferably externally accessible to facilitate necessary adjustments. A rotation counter 48 includes a counter sprocket 50 for engaging the chain to detect movement thereof. The counter thereby indicates to the operator 14 via a display (not shown) the amount of cable remaining. Alternatively, a vehicle controller (not shown) may be connected to the counter to prevent the vehicle from being driven past the range of its cable.

A cable guide mechanism 52 is slidably mounted for reciprocation and pivoting on a guide shaft 54 that is fixed to the vehicle in a transverse horizontal orientation. The cable guide 52 includes a pair of opposed parallel chassis plates 56 that are interconnected at their upper ends by a pair of transverse plates 58. An inner bumper 59 attached to the housing and an outer bumper portion 60 of the reel housing 16 are positioned with the transverse plates 58 received therebetween to limit the pivoting action of the cable guide 52 by contact with the bumpers.

Figure 3:
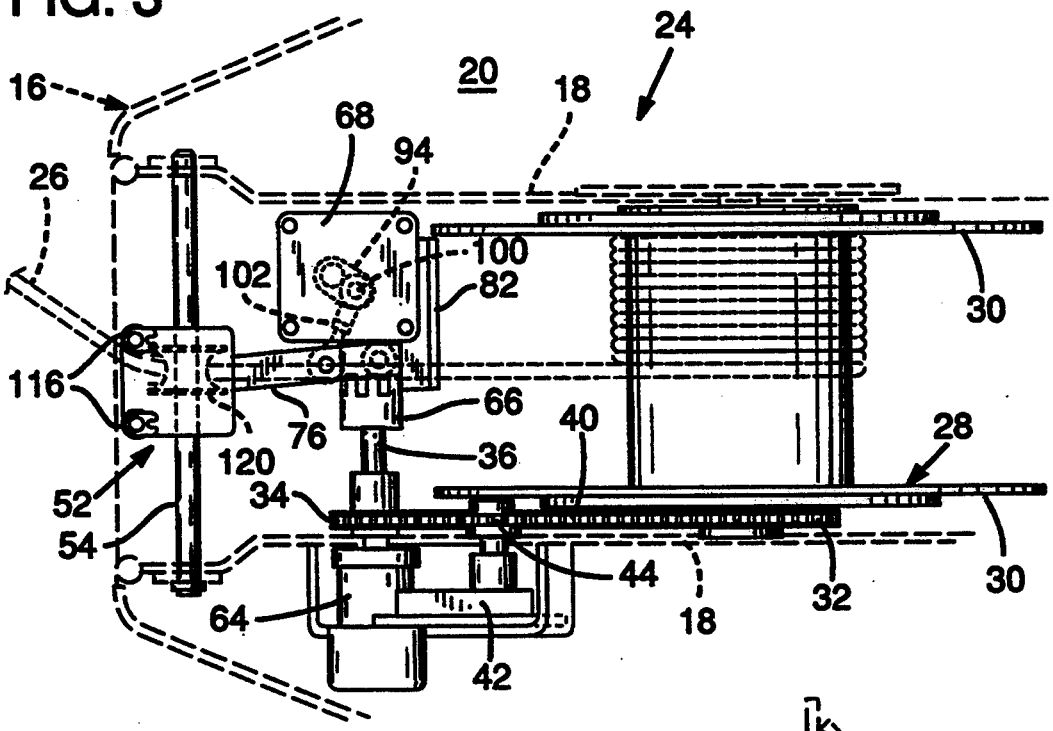
FIG. 3 is a top view of the embodiment of FIG. 1.

As shown in FIG. 3, the motor shaft 36 is connected to a hydraulic motor 64 that is fixed to the vehicle. The motor is preferably of a GEROLER type, such as Model 103-1537 manufactured by CHAR-LYNN. The motor is interconnected with the vehicle hydraulic system (not shown) to provide a generally consistent torque so that the cable is maintained at a predetermined tension at all times, regardless of whether the cable is paying out or reeling in. The shaft 36 includes a coupling 66 to accommodate any misalignment. The shaft 36 enters a gearbox 68 attached to the vehicle and having a rotatable crank or eccentric drive shaft 72 extending vertically downward therefrom. A worm gear mechanism (not shown) contained within the gearbox interconnects the motor shaft 36 to the eccentric drive shaft 72 so that the motor drive shaft makes numerous rotations for every single rotation of the eccentric drive shaft.

As further shown in FIG. 3, the reel end plates 30 are closely received between vertical plate portions of the reel housing upper portion 18.

As shown in FIG. 4, a drive linkage 74 operably connects the eccentric drive shaft 72 to the cable guide mechanism 52 so that rotation of the eccentric drive shaft causes reciprocation of the cable guide mechanism. The drive linkage 74 includes a lever or pivot arm 76 having a pivot end 78 attached to a fixed frame portion 82 of the vehicle to pivot about a pivot point 84 on a vertical axis. The pivot arm 76 has an opposed free end 84 that is connected at a ball joint 86 to a guide arm 90 that is pivotally attached to the guide axle 54, but otherwise constrained between a pair of cable guide bushings 92, which slide freely on the guide axle, and to which the chassis plates 56 are attached.

A crank arm or eccentric drive bar 94 is fixed to the drive shaft 72 and has a free end 98 that carries a drive point 100 through a circular path 101 having a predetermined limited diameter. A connecting rod 102 having a first end 106 and a second end 108 is pivotally attached at its first end 106 to the drive point 100 of the drive bar 94 and at its second end 108 to an intermediate drive point or attachment point 112 on the pivot arm 76. To provide a wide reciprocation of the cable guide 52 while maintaining a compact mechanism having a short crank or drive bar 94, the intermediate attachment point 112 is positioned close to the pivot point 84 at a distance of preferably between one-half and one-quarter the overall length of the pivot arm 76. Thus, the motion of the eccentric drive is amplified by several times.

The entire drive linkage 74, and particularly the eccentric crank arm 94, is received between the vertical plate portions of the reel housing upper portion 18. Because the reel end plates 30 are proximate the housing upper portion 18, the drive linkage 74, including substantially all of the gear box 68, is contained between imaginary planes defined by the reel end plates 30.

As further shown in FIG. 4, the cable guide mechanism 52 includes a pair of horizontal plates 114 attached to the chassis plates 56 and spaced apart to receive therebetween a pair of spaced-apart vertical guide rollers 116. A pair of horizontal guide rollers 120 are rotatably mounted on horizontal axles 122 received between the chassis plates 56. The horizontal guide rollers 120 are each dual-flanged with a peripheral channel between the flanges and having a semicircular profile sized to closely receive the cable 26. The guide rollers 120 are mounted in alignment with each other so that their respective flanges are spaced apart by only a small distance substantially less than the cable diameter. An essentially closed circular path is thereby defined by the peripheral channels of the adjacent guide rollers so that the cable may not escape the channel. To accommodate a range of angular positions of the trailing cable 26, the horizontal guide rollers 120 may be slidably mounted on the horizontal axles 122, thereby avoiding lateral pressure between the cable and the rollers 120.

OPERATION

As the vehicle 10 drives forward, cable 26 is paid out, causing the cable reel 28 to rotate. This rotation drives the drive chain 40, which rotates the motor drive shaft 36. The gearbox 68 converts the drive shaft rotation into a much slower rotation of the eccentric drive shaft 72. The resulting circular motion of the eccentric drive bar 94 is converted through connecting rod 102 to a cyclical pivoting motion of the pivot arm 76. This cyclical motion is approximately sinusoidal, but not precisely so due to the finite length of the connecting rod 102. Accordingly, the cable guide mechanism 52 reciprocates on the guide axle 54 with a complete reciprocation cycle occurring during the period in which two complete layers of coiled cable are unwound from the cable reel 28.

Similarly, when the vehicle is driven in reverse so that cable is rewound onto the reel, the cable guide 52 reciprocates to follow a position approximately aligned with the coil of cable currently being wound onto the reel. Consequently, the coils of cable will be neatly and closely wound without spaces therebetween and without the last coil prematurely wrapping atop the previous coil to form a second layer before the first layer is entirely formed across the entire reel.

The nearly sinusoidal motion of the cable guide is adequate to provide neat and compact winding because of the tendency of the cable to form closely wound coils as long as the cable is not excessively angularly offset from the perpendicular to the reel axle. Accordingly, the reciprocation range of the cable guide need not equal fully the length of the cable reel between the end plates 30. A ball reverser, it should be noted, would provide an unnecessarily precise alignment of the cable guide with the coil being wound without any functional advantage.

EXAMPLE

In the preferred embodiment, the reel has a length or distance between the reel end plates 30 of 10.5 in so that with a cable diameter of 1.05", there are 10 closely wound coils formed in a single layer of cable wound on the,reel. Accordingly, the gearbox mechanism has a drive ratio of 40:1 to provide a single rotation of the eccentric crank arm 94 for every 40 rotations of the motor shaft 36; the motor sprocket 34-to-reel sprocket 32 drive ratio is 2.22:1. Consequently, the reel rotates 18 times for a single cable guide reciprocation. The drive bar 94 has an effective length of 1.18 in. The connecting rod 102 has an effective length between its pivot axes of 3.47 in. The pivot arm 76 has an effective length of 9.28 in. with the second end 108 of the connecting rod 102 mounted at the intermediate attachment point 112, which is spaced apart from the pivot arm pivot point 84 by 2.32 in. Accordingly, the free end 84 of the pivot arm sweeps out a path that reciprocates the cable guide 52 over a range of 9.44 in. The hydraulic motor is continuously powered to provide a torque of 474 in.-lb. so that the cable remains under a tension in the range of 212 lbs. to 289 lbs.

While the mechanism is described as employing a hydraulic motor, it is contemplated that a spring or other elastic energy storage mechanism, or an electric or other motor may be employed to maintain cable tension.

Thus, having illustrated and described the principles of my invention by what is presently a preferred embodiment, it should be apparent to those persons skilled in the art that the illustrated embodiment may be modified without departing from such principles. I claim as my invention not only the illustrated embodiment, but all such modifications, variations and equivalents thereof as come within the true spirit and scope of the following claims.

I claim:

1. A mechanism for evenly winding cable onto a reel comprising:

a take-up reel rotatable about a reel axis;

a cable guide movable on a stationary guide shaft through a range of motion along a linear path substantially parallel to the reel axis relative to the reel for guiding the cable evenly onto the reel;

an eccentric drive for rotating a drive point in a circular path; and a drive linkage operably connecting the drive point of the eccentric drive to a fixed point on the cable guide so that the range of linear motion of the cable guide on the guide shaft is greater than the diameter of the circular path of the drive point.

2. The mechanism of claim 1 wherein the eccentric drive is operably connected to the take-up reel to rotate proportionally therewith.

3. The mechanism of claim 2 including a worm gear mechanism connecting the eccentric drive to the take-up reel.

4. The mechanism of claim 1 wherein the eccentric drive is operably connected to the take-up reel such that the cable guide moves in response to rotation of the reel.

5. A mechanism for evenly winding cable onto a reel comprising:

a take-up reel rotatable about a reel axis:

a cable guide movable through a range of motion along a linear path substantially parallel to the reel axis relative to the reel for guiding the cable evenly onto the reel;

an eccentric drive for rotating a drive point in a circular path; and a drive linkage operably connecting the drive point of the eccentric drive to the cable guide so that the range of motion of the cable guide is greater than the diameter of the circular path of the drive point, the drive linkage including a pivot arm having a fixed pivot point and a free end attached to the cable guide, the arm being operable for pivoting movement within a substantially horizontal plane.

6. The mechanism of claim 5 wherein the drive linkage further includes a connecting rod operably connecting the eccentric drive to a driven point on the pivot arm, such that rotation of the eccentric causes cyclical pivoting of the pivot arm.

7. The mechanism of claim 6 wherein the driven point is separated from the pivot point by a first distance, and the free end is separated from the pivot point by a second distance greater than the first distance, such that the cyclical motion of the eccentric drive is amplified to create a wider motion by the arm free end.

8. An electric vehicle powered by a trailing cable connected to a power source comprising:

a cable reel mounted on a rear portion of the vehicle and rotatable on an axis;

a reel controller for turning the reel to take up and pay out cable as the vehicle moves toward and away from the power source;

a cable guide mounted to the vehicle for relative movement with the cable reel over a range of motion along a guide axis generally parallel to the reel axis;

a crank arm for moving a drive point in a circular path; and a drive linkage operably connecting the drive point to a fixed point on the cable guide so that the range of motion of the cable guide along the guide axis is greater than the diameter of the crank arm circular path and so that upon movement of the cable guide along the guide axis, the cable guide also pivots about the guide axis.

9. The vehicle of claim 8 wherein the cable guide is pivotally mounted to accommodate a wide range of angular dispositions of the cable relative to a first cable portion extending between the reel and the guide to reduce binding and frictional forces at the guide.

10. The vehicle of claim 8 wherein the drive linkage includes a pivot arm having a first end pivotally connected to the vehicle for movement within a generally horizontal plane.

11. The vehicle of claim 8 wherein the reel controller is operably connected to the reel to rotatably bias the reel with a preselected torque such that the reel maintains sufficient tension to take up cable as the vehicle moves at maximum speed toward the trailing cable.

12. The vehicle of claim 8 wherein the crank arm is operably connected to the cable reel to rotate at a proportionate drive ratio therewith.

13. The vehicle of claim 12 including a worm gear mechanism operably connecting the eccentric drive to the take-up reel.

14. The vehicle of claim 8 wherein the drive linkage includes a lever having a fulcrum and having a free end operably connected to the cable guide.

15. The vehicle of claim 14 wherein the drive linkage further includes a connecting rod operably connected to a driven point on the pivot arm, such that rotation of the crank arm causes cyclical pivoting of the lever.

16. The vehicle of claim 8 wherein the drive linkage is connected to drive the cable guide in a generally sinusoidal motion in response to rotation of the reel.

17. The vehicle of claim 8 wherein the reel controller includes a hydraulic motor.

18. An electric vehicle powered by a trailing cable connected to a power source comprising:

a cable reel mounted on a rear portion of the vehicle and rotatable on an axis;

a reel controller for turning the reel to take up and pay out cable as the vehicle moves toward and away from the power source;

a cable guide mounted to the vehicle for relative movement with the cable reel over a range of motion, wherein the cable guide pivots on an axis generally parallel to the cable reel axis to accommodate a wide range of angular dispositions of the cable relative to a first cable portion extending between the reel and the guide to reduce binding and frictional forces at the guide;

a crank arm for moving a drive point in a circular path; and a drive linkage operably connecting the drive point to the cable guide so that the range of motion of the cable guide is greater than the diameter of the crank arm circular path.

19. An electric vehicle powered by a trailing cable connected to a power source comprising:

a cable reel fixed to a shaft mounted on a rear portion of the vehicle for rotation on a generally horizontal axis;

a reel controller for turning the shaft to take up and pay out cable as the vehicle moves toward and away from the power source;

a cable guide mounted to the vehicle for movement relative to the cable reel over a linear path of motion, the cable guide having a rotatable bearing defining at least in part an aperture for receiving the cable without substantial frictional resistance to passage of the cable through the aperture when the cable is forced against the bearing, thereby permitting cable to be paid out under tension while retained by the aperture;

the cable guide being mounted for pivoting movement about a guide pivot axis substantially parallel to the linear path of motion of the guide, permitting accommodation of a wide range of vertical angular dispositions of the trailing cable;

a crank arm for moving a drive point in a circular path; and a drive linkage operably connecting the drive point to the cable guide so that the range of motion of the cable guide path is greater than the diameter of the crank arm circular path.

20. In a low-profile electric drive underground mining vehicle powered from a remote source of electric power through an electric power cable, the vehicle having forward and rear end portions and a defined height and width, the vehicle comprising:

a cable storage reel mounted at the rear end portion of the vehicle for rotation about a reel axis extending transversely of the vehicle to enable cable to be taken up by the reel and paid out from the reel at the rear end portion as the vehicle moves forward and rearward;

a controller operatively connected to the reel for applying a relatively constant torque to the reel such that forward and rearward movement of the vehicle causes the reel to rotate about its axis and pay out or take up cable under a relatively constant cable tension;

a cable guide on the vehicle rearward of the reel, said cable guide including a guide shaft extending parallel to the reel axis in a fixed position, and a guide sleeve mounted for reciprocative movement along the guide shaft and pivotal movement about the guide shaft to guide the cable in even wraps onto and off of the reel; and a cable guide drive on the vehicle for reciprocating and pivoting the guide sleeve on the guide shaft in timed relation to rotation of the reel.

21. The apparatus of claim 20 wherein the cable guide further comprises a fairlead including two pairs of guide rollers and carried by the guide sleeve for movement therewith and for guiding the cable onto and off of the reel.

22. The apparatus of claim 20 wherein the cable guide drive comprises a drive shaft rotatable in opposite directions about its axis in response to fore and aft movement of the vehicle;

a drive bar fixed at one end to the drive shaft for rotation therewith and having a free end describing a circular path upon rotation of the drive shaft;

a connecting rod pivotally connected at a first end to the free end of the drive bar, the connecting rod having a second end opposite the first end;

a pivot arm attached at one end to a fixed pivot connection on the vehicle for pivoting movement about an axis parallel to the axis of rotation of the drive shaft, the pivot arm having an opposite end connected at a universal connection to the guide sleeve; and the second end of the connecting rod being pivotally connected to the pivot arm at an attachment point along the pivot arm closer to the fixed pivot connection than to the universal connection, such that rotation of the drive bar in its circular path by the drive shaft causes oscillatory movement of the pivot arm and amplified reciprocative and pivoting movement of the guide sleeve on said guide shaft through a linear distance substantially greater than the diameter of the circular path of the drive bar.

23. The apparatus of claim 20 wherein the vehicle has a reel housing that houses the reel, the cable guide and the cable guide drive, the housing being within the defined height and width of the vehicle, and an operator seat mounted above the reel housing.

24. A power cable take-up reel assembly for mounting on an electric vehicle powered by a trailing cable connected to a remote power source, the assembly comprising:

a cable reel rotatable about a reel axis to enable cable to be taken in to the reel and paid out from the reel as a vehicle on which it is mounted moves forward and rearward;

a cable guide movable through a range of motion for guiding the cable evenly onto and off of the reel; and a drive mechanism for the cable guide operable in response to rotation of the cable reel, the drive mechanism comprising:

(a) a pivot arm having one end connected to a fixed pivotal connection and an opposite end connected to the cable guide;

(b) an eccentric drive for rotating a drive point in a circular path; and (c) a connecting rod having a first end pivotally attached to the drive point, the connecting rod having a second end pivotally attached to the pivot arm at an attachment point substantially closer to the one end than the opposite end of the pivot arm, such that rotation of the eccentric drive yields a cable guide range of motion that is more than twice the diameter of the circular path of the eccentric drive.

25. The assembly of claim 24, wherein the length of the connecting rod between the first and second ends is approximately equal to the diameter of the circular path of the eccentric drive.

26. The assembly of claim 24 wherein the cable guide is slidable linearly and pivotable on a guide shaft, and a guide arm has a universal attachment to the opposite end of the pivot arm and a fixed connection to the cable guide such that linear movement of the cable guide back and forth on the guide shaft causes oscillating movement of the cable guide on the shaft.

* * * * *

UNITED STATES PATENT AND TRADEMARK OFFICE

CERTIFICATE OF CORRECTION

PATENT NO. : 5,385,314

DATED : January 31, 1995

INVENTOR(S) : Daniel L. Hughes

It is certified that error appears in the above-identified patent and that said Letters Patent is hereby corrected as shown below:

Column 2, line 16, "," should be --.--.

Column 2, line 24, "," should be --.--.

Column 2, line 33, "," should be --.--.

Column 2, line 36, "," should be --.--.

Column 4, line 54, "the,reel" should be -- the reel--.

Signed and Sealed this

Twenty-fifth Day of July, 1995

Bruce Lehman

*Attest:*

BRUCE LEHMAN

*Attesting Officer*

*Commissioner of Patents and Trademarks*